US008093981B2

(12) United States Patent
Chung

(10) Patent No.: US 8,093,981 B2
(45) Date of Patent: Jan. 10, 2012

(54) LAMINATED INDUCTOR WITH ENHANCED CURRENT ENDURANCE

(75) Inventor: Jui-Min Chung, Hsin-Chu (TW)

(73) Assignee: Mag. Layers Scientific-Technics Co., Ltd., Hsin-Chu (TW)

( * ) Notice: Subject to any disclaimer, the term of this patent is extended or adjusted under 35 U.S.C. 154(b) by 162 days.

(21) Appl. No.: 12/712,129

(22) Filed: Feb. 24, 2010

(65) Prior Publication Data

US 2011/0032066 A1 Feb. 10, 2011

(30) Foreign Application Priority Data

May 8, 2009 (TW) ..... 98207913 U

(51) Int. Cl.
*H01F 5/00* (2006.01)

(52) U.S. Cl. ..... 336/200; 336/218; 336/219; 336/223; 336/232; 336/234

(58) Field of Classification Search ..... 336/200, 336/218, 219, 223, 232, 234
See application file for complete search history.

(56) References Cited

U.S. PATENT DOCUMENTS 6,264,777 B1 * 7/2001 Yamaguchi ..... 156/89.12
7,304,557 B2 * 12/2007 Tsuzuki et al. ..... 336/200
7,453,343 B2 * 11/2008 Ito et al. ..... 336/200
7,719,398 B2 * 5/2010 Tsuzuki ..... 336/200
7,719,399 B2 * 5/2010 Iwasaki ..... 336/200
7,817,007 B2 * 10/2010 Lee et al. ..... 336/200
7,839,735 B2 * 11/2010 Shiraishi ..... 369/47.31
7,907,044 B2 * 3/2011 Tada et al. ..... 336/200
7,994,889 B2 * 8/2011 Okabe et al. ..... 336/200
8,004,381 B2 * 8/2011 Katayama et al. ..... 336/200

* cited by examiner

*Primary Examiner* — Anh Mai
*Assistant Examiner* — Joselito Baisa
(74) *Attorney, Agent, or Firm* — Leong C. Lei

(57) ABSTRACT

A laminated inductor includes a plurality of magnetic plates, each having a surface to which a high-permeability magnetic body is attached, and at least one spacer assembly interposed between the magnetic plates. The spacer assembly includes two magnetic boards having moderate magnetic permeability and a magnetic board having low magnetic permeability interposed between the two moderate-permeability magnetic boards. Both moderate-permeability and low-permeability boards are provided, at a surface of each board, with a magnetic body having high permeability. A magnetic top lid and a magnetic bottom lid are respectively set on outside surfaces of the topmost and bottommost ones of the magnetic plates. The high-permeability magnetic bodies mounted to the magnetic plates and the arrangement of the spacer assembly help improve the characteristic of DC superimposition of the laminated inductor thereby enhancing current endurance thereof.

10 Claims, 6 Drawing Sheets

LAMINATED INDUCTOR WITH ENHANCED CURRENT ENDURANCE

TECHNICAL FIELD OF THE INVENTION

The present invention generally relates to a laminated inductor with enhanced current endurance, and more particularly to a laminated inductor that improves the characteristics of DC (direct current) superimposition and expands the applications of the laminated inductor.

DESCRIPTION OF THE PRIOR ART

Taiwan Utility Model No. M331734 discloses a laminated inductor that enhances current endurance. As shown in FIG. 1 of the attached drawings, the conventional laminated inductor is composed of a plurality of magnetic plates 71 sequentially stacked on each other. At least one spacer layer 73 is interposed between the magnetic plates 71. The spacer layer 73 is formed of two magnetic plates 731 having high magnetic permeability and another magnetic plate 732 having low magnetic permeability interposed between the magnetic plates 731. The topmost magnetic plate 71 is covered by a magnetic lid 74 to thereby improve the characteristics of DC superimposition of the known laminated inductor.

The known laminated inductor is effective in improving the DC superimposition characteristics of laminated inductor. However, each of the magnetic plates 71 is only provided with a conductor pattern 73 printed thereon and since the spacer layer 73 is formed of two high-permeability magnetic plates 731 interposing a low-permeability magnetic plate 732, the improvement that the conventional laminated inductor can achieve in respect of the characteristics of DC superimposition is very limited. Further, such a known laminated inductor shows a rapid lowering curve of inductance, as indicated by curve 42 shown in FIG. 2, for applications of higher than 1,200 mA (a large current), so that the applications thereof are limited. Thus, further improvement is desired.

The present invention is thus made to overcome the above discussed problems by providing a laminated inductor with enhanced current endurance.

SUMMARY OF THE INVENTION

The primary purpose of the present invention is to provide a laminated inductor with enhanced current endurance, which comprises the following constituent components:

A plurality of magentic plates is stacked sequentially to form the laminated inductor. The laminated inductor has opposite ends that are respectively mounted to electrode contacts. Each of the magentic plates comprises a magnetic plate, which has moderate magnetic permeability. The moderate-permeability magnetic plate shows a value of magnetic permeability (μi) in the range of 60-300 for a frequency below 100 MHz. The magentic plates are printed with conductor patterns and form through holes. Further, each of the magentic plates is provided, on a surface thereof, with a magnetic body having high permeability. The high-permeability magnetic body shows a value of magnetic permeability (μi) in the range of 400-1,000 for a frequency below 100 MHz. The topmost magentic plate of the stacked magentic plates is provided with a conductive terminal.

At least one spacer assembly is interposed between the magentic plates. The spacer assembly is formed of two magnetic plates having moderate magnetic permeability interposing therebetween a magnetic plate having low permeability. The low-permeability magnetic plate shows a value of magnetic permeability (μi) in the range of 1-30 for a frequency below 100 MHz. Further, the moderate-permeability magnetic plates of the spacer assembly are each provided with a high-permeability magnetic body, and the moderate-permeability magnetic plates each form a through hole. The low-permeability magnetic plate of the spacer assembly is provided with a high-permeability magnetic body and forms a through hole.

A magnetic top lid is set on and covers an outside surface of the topmost one of the magentic plates. The magnetic top lid is of high magnetic permeability and the high-permeability magnetic lid shows a value of magnetic permeability (μi) in the range of 400-1,000 for a frequency below 100 MHz.

A magnetic bottom lid is stacked on an outside surface of a bottomost one of the magentic plates. The magnetic bottom lid is of high magnetic permeability and the high-permeability magnetic bottom lid shows a value of magnetic permeability (μi) in the range of 400-1,000 for a frequency below 100 MHz. Further, the magnetic bottom lid is printed with a conductor pattern. The magnetic bottom lid is provided with a conductive terminal. The magnetic bottom lid and the magnetic top lid are arranged to interpose therebetween the plurality of sequentially stacked magentic plates and the at least one spacer assembly to construct the laminated inductor with the opposite ends of the laminated inductor being respectively coupled to the electrode contacts.

With each of the magentic plates being provided on a surface thereof with a high-permeability magnetic body, and further due to the arrangement of the spacer assembly, the DC (direct current) superimposition characteristics of the laminated inductor according to the present invention is significantly improved, allowing for wide applications of the laminated inductor of the present invention and thus realizing a laminated inductor with enhanced current endurance.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 3:
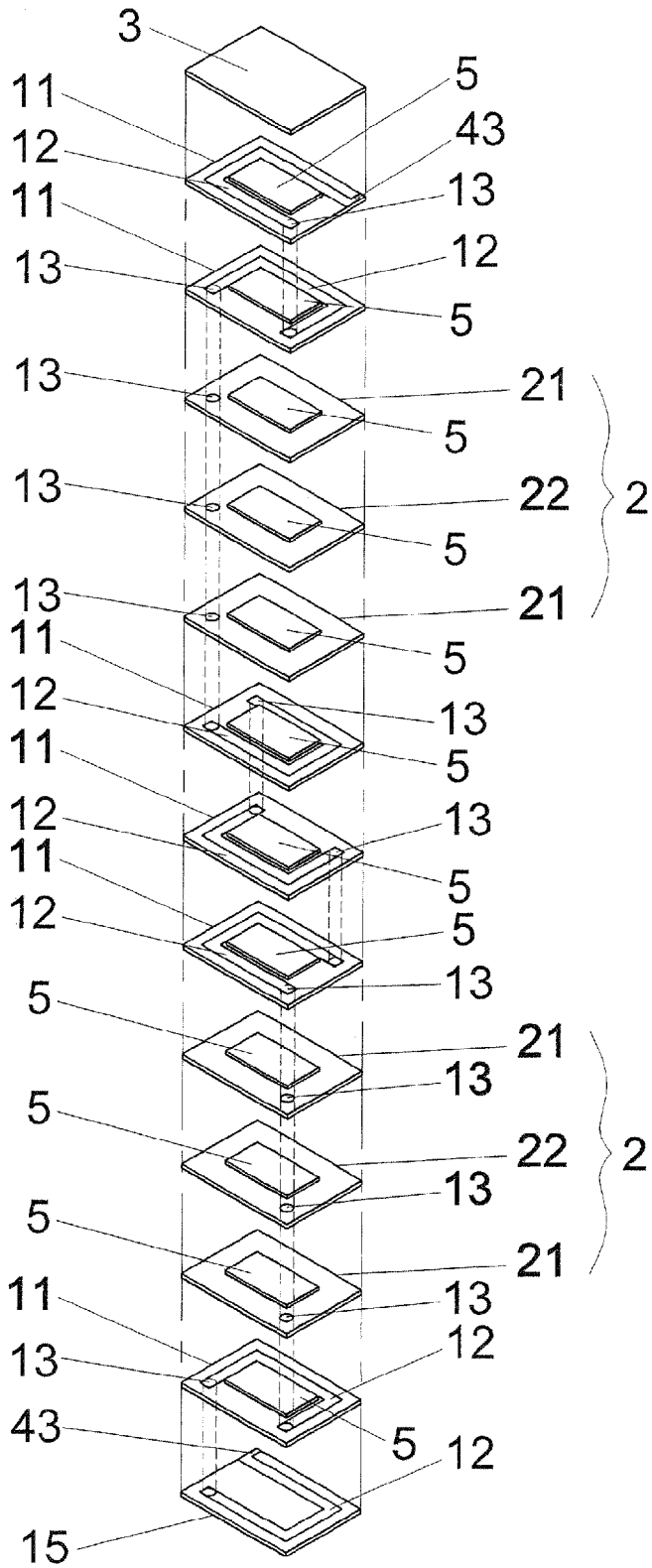
FIG. 3 is an exploded view of a laminated inductor according to the present invention.

Referring to FIG. 3, the present invention provides a laminated inductor that shows enhanced current endurance. The laminated inductor of the present invention comprises the following components.

Figure 4:
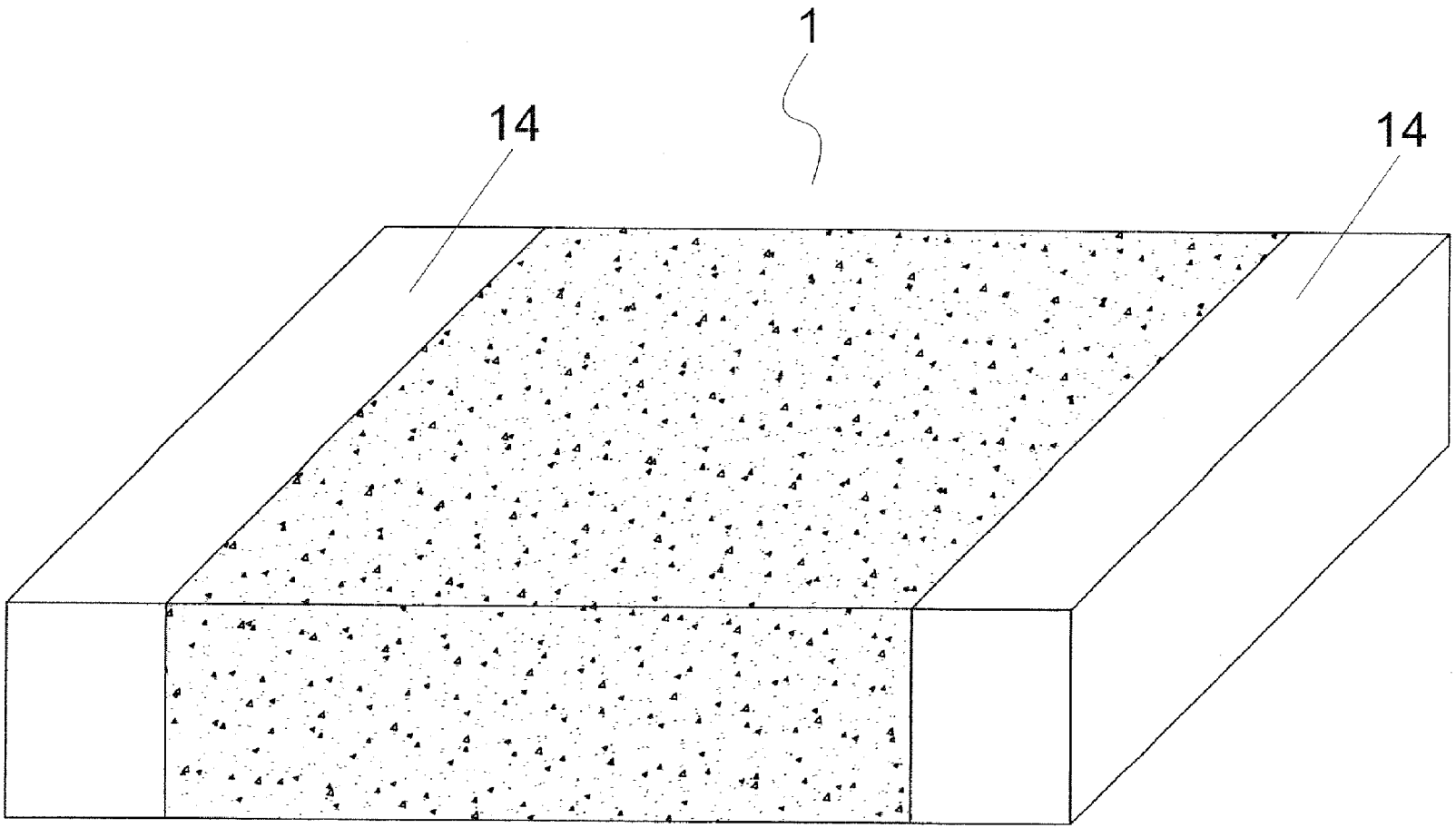
FIG. 4 is a perspective view showing the laminated inductor according to the present invention.

A plurality of magentic plates 11 is stacked sequentially to form the laminated inductor, which is generally designated at 1, as shown in FIG. 4. The laminated inductor 1 has opposite ends that are respectively mounted to two electrode contacts 14. Each of the magentic plates 11 comprises a magnetic plate, which has moderate magnetic permeability and will be referred to as moderate-permeability magnetic plate hereinafter. The moderate-permeability magnetic plate shows a value of magnetic permeability (μi) in the range of 60-300 for a frequency below 100 MHz. The magentic plates 11 are printed with conductor patterns 12. Further, the magentic plates 11 are provided with through holes 13. Further, each of the magentic plates 11 is provided, on a surface thereof, with a magnetic body 5 having high permeability, which will be referred to as high-permeability magentic body hereinafter. The high-permeability magnetic body 5 shows a value of magnetic permeability (μi) in the range of 400-1,000 for a frequency below 100 MHz. The topmost magentic plate 11 of the plurality of stacked magentic plates 11 is provided with a conductive terminal 43, which is in electrical connection with a respective electrode contact 14 of the laminated inductor 1.

At least one spacer assembly 2 is interposed between the magentic plates 11. The spacer assembly 2 is formed of two magnetic plates 21 having moderate magnetic permeability (which will be referred to as moderate-permeability magnetic plates hereinafter) interposing therebetween a magnetic plate 22 having low permeability (which will be referred to as low-permeability magnetic plate hereinafter). The low-permeability magnetic plate 22 shows a value of magnetic permeability (μi) in the range of 1-30 for a frequency below 100 MHz. Further, the moderate-permeability magnetic plates 21 of the spacer assembly 2 are each provided with a high-permeability magnetic body 5, and the moderate-permeability magnetic plates 21 each form a through hole 13. The low-permeability magnetic plate 22 of the spacer assembly 2 is provided with a high-permeability magnetic body 5, and the low-permeability magnetic plate 22 forms a through hole 13.

A magnetic top lid 3 is set on and covers an outside surface of the topmost one of the magentic plates 11. The magnetic top lid 3 is of high magnetic permeability and the high-permeability magnetic lid shows a value of magnetic permeability (μi) in the range of 400-1,000 for a frequency below 100 MHz.

A magnetic bottom lid 15 is stacked on an outside surface of a bottomost one of the magentic plates 11. The magnetic bottom lid 15 is of high magnetic permeability and the high-permeability magnetic bottom lid shows a value of magnetic permeability (μi) in the range of 400-1,000 for a frequency below 100 MHz. Further, the magnetic bottom lid 15 is printed with a conductor pattern 12 and the magnetic bottom lid 15 is provided with a conductive terminal 43. The magnetic bottom lid 15 and the magnetic top lid 3 are arranged to interpose therebetween the plurality of sequentially stacked magentic plates 11 and the at least one spacer assembly 2 to construct the laminated inductor 1 with the opposite ends of the laminated inductor 1 being respectively coupled to the electrode contacts 14.

Figure 5:
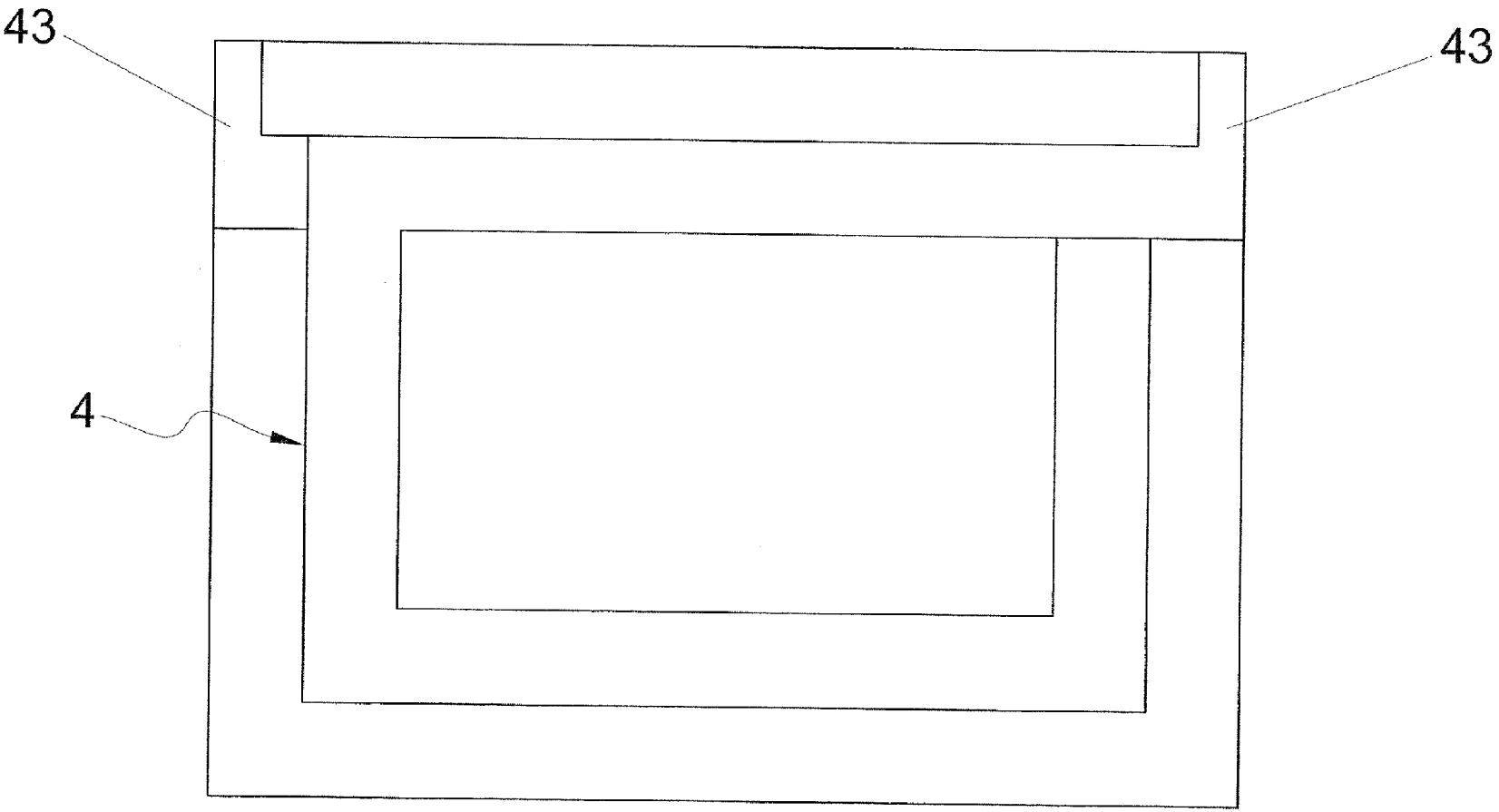
FIG. 5 is a top plan view of the laminated inductor according to the present invention.
Figure 6:
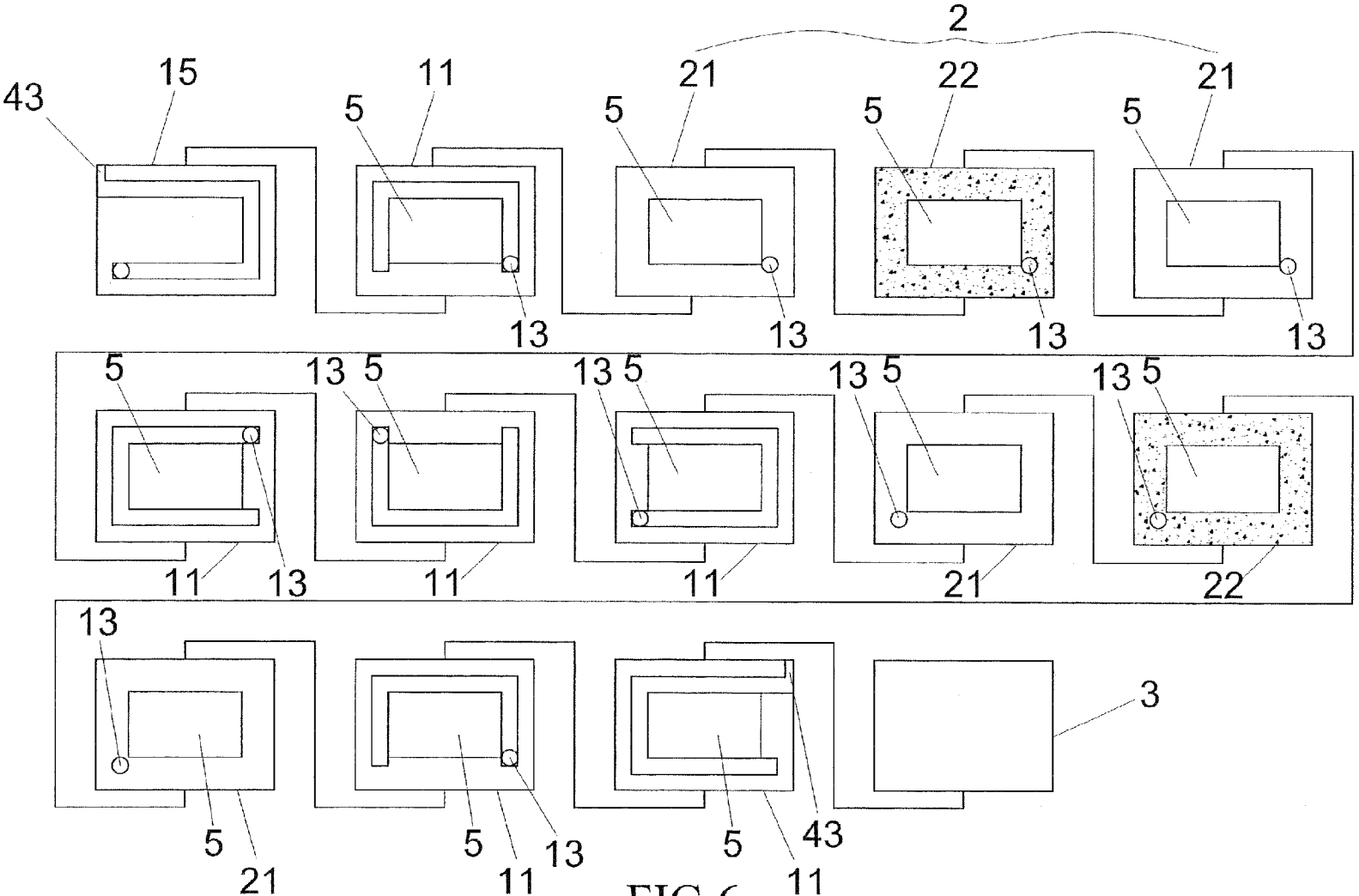
FIG. 6 is a schematic view illustrating the arrangement of each layer of the laminated inductor according to the present invention.

Referring to FIGS. 3 and 6, with each of the magentic plates 11 forming a through hole 13, when the plurality of magentic plates 11 and the at least one spacer assembly 2 are sequentially stacked between the magnetic bottom lid 15 and the magnetic top lid 3 to form the laminated inductor 1, the conductor pattern 12 of the magnetic bottom lid 15 and the conductor patterns 12 of the plurality of magentic plates 11 can be set in electrical connection with each other. Due to the electrical connection formed between adjacent conductor patterns 12, the inter-connected conductor patterns construct a helically arranged coil 4, as shown in FIG. 5, with opposite ends of the coil 4 being constituted by the two terminals 43, which are respectively set in electrical connection with the electrode contacts 14 mounted to the opposite ends of the laminated inductor 1.

Figure 1:
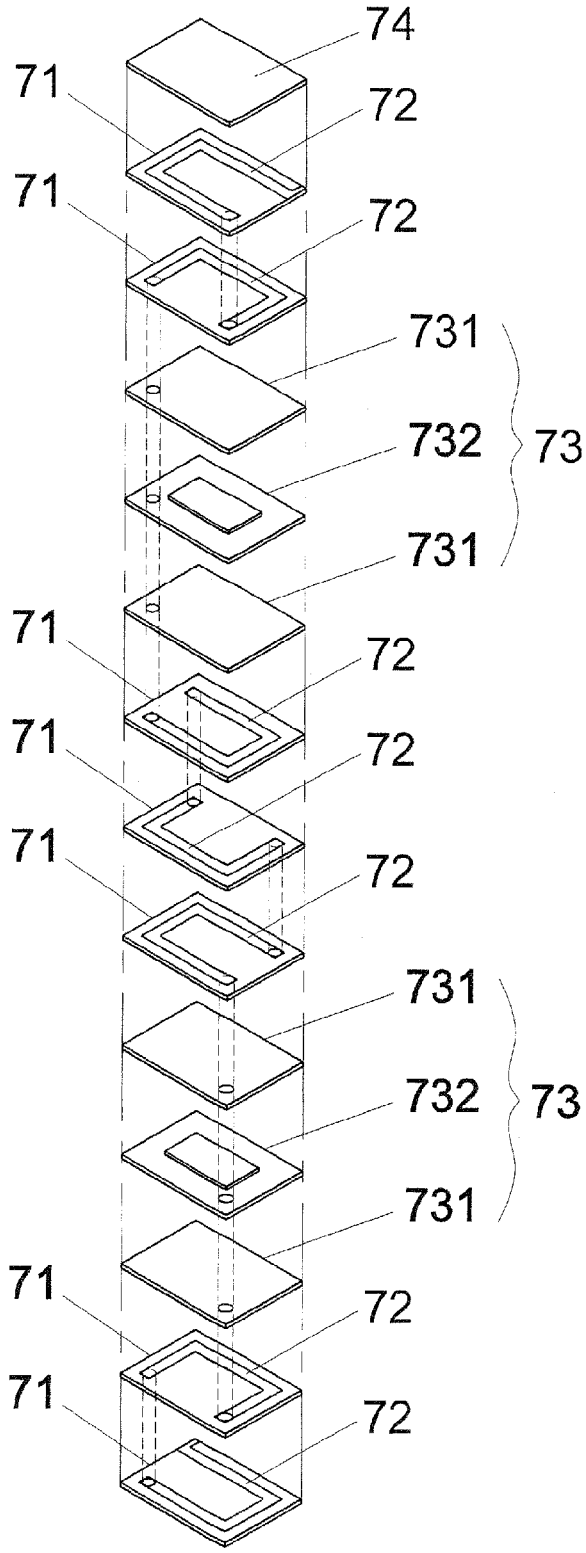
FIG.1 PRIOR ART
FIG. 1 is an exploded view showing a conventional laminated inductor.
Figure 2:
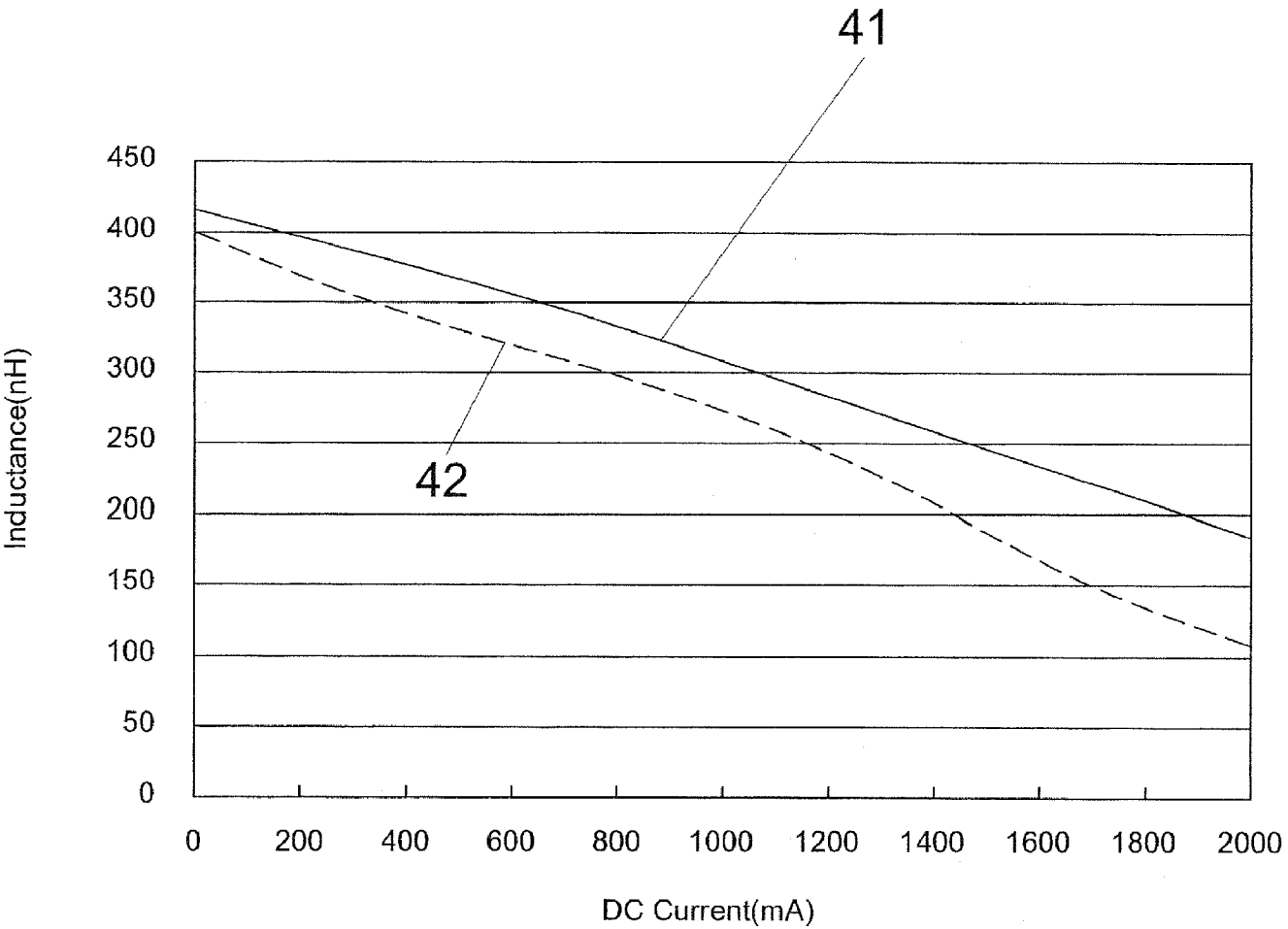
FIG.2 PRIOR ART
FIG. 2 is a plot showing characteristics curves of a conventional laminated inductor and a laminated inductor according to the present invention.

Referring to FIGS. 2 and 3, with each of the magentic plates 11 being provided on a surface thereof with a high-permeability magnetic body 5, and further due to the arrangement of the spacer assembly 2, DC (direct current) superimposition characteristics of the laminated inductor 1 is significantly improved, whereby the laminated inductor 1 of the present invention shows a gently lowering curve of inductance as indicated by curve 41 shown in FIG. 2, when used in a large current application. This allows for wide applications of the laminated inductor 1 of the present invention to thereby realize a laminated inductor with enhanced current endurance.

A comparison between the present invention and a conventional laminated inductor is provided below to show the improvement and practicability of the present invention over a known laminated inductor:

Conventional Laminated Inductor (1) Only limited enhancement of DC superimposition characteristics (2) Only limited applications The Present Invention:

(1) Significant improvement of DC superimposition characteristics of the laminated inductor to allow for applications in large currents and the inductance showing a gently lowering curve (2) Expanded applications.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A laminated inductor, comprising:

a plurality of the magnetic plates, which is sequentially stacked to form a laminated inductor, which has opposite ends to which two electrode contacts are respectively mounted, each of the magnetic plates being printed with a conductor pattern and forming a through hole, each of the magnetic plates having a surface to which a high-permeability magnetic body is mounted, the plurality of magnetic plates comprising a topmost magnetic plate to which a conductive terminal is mounted and in electrical connection with a respective electrode contact of the laminated inductor; and at least one spacer assembly, which is interposed between the magnetic plates and is formed of two moderate-permeability magnetic plates interposing therebetween a low-permeability magnetic plate, each of the moderate-permeability magnetic plates of the spacer assembly comprising a high-permeability magnetic body mounted thereto and forming a through hole, the low-permeability magnetic plate of the spacer assembly comprising a high-permeability magnetic body mounted thereto and forming a through hole.

2. The laminated inductor according to claim 1, wherein the magnetic plates shows moderate magnetic permeability that has a value in the range of 60-300 for a frequency below 100 MHz.

3. The laminated inductor according to claim 1, wherein the high-permeability magnetic body shows a value of magnetic permeability in the range of 400-1,000 for a frequency below 100 MHz.

4. The laminated inductor according to claim 1, wherein the low-permeability magnetic plate shows a value of magnetic permeability in the range of 1-30 for a frequency below 100 MHz.

5. The laminated inductor according to claim 1, wherein the topmost magnetic plate of the plurality of magnetic plates has an outside surface on which a magnetic top lid is set.

6. The laminated inductor according to claim 5, wherein the magnetic top lid shows high magnetic permeability that has a value in the range of 400-1,000 for a frequency below 100 MHz.

7. The laminated inductor according to claim 1, wherein the plurality of the magnetic plates comprises a bottommost magnetic plate that has an outside surface on which a magnetic bottom lid is set.

8. The laminated inductor according to claim 7, wherein the magnetic bottom lid shows high magnetic permeability that has a value in the range of 400-1,000 for a frequency below 100 MHz.

9. The laminated inductor according to claim 7, wherein the magnetic bottom lid is printed with a conductor pattern.

10. The laminated inductor according to claim 7, wherein the magnetic bottom lid forms a conductive terminal.

* * * * *